US007182621B2

(12) United States Patent
Reichle

(10) Patent No.: US 7,182,621 B2
(45) Date of Patent: Feb. 27, 2007

(54) PROTECTION DEVICE FOR A PLUG-IN CONNECTION

(75) Inventor: Hans Reichle, Wetzikon (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 10/484,582

(22) PCT Filed: Jul. 31, 2001

(86) PCT No.: PCT/CH01/00465

§ 371 (c)(1),
(2), (4) Date: Jan. 23, 2004

(87) PCT Pub. No.: WO03/012932

PCT Pub. Date: Feb. 13, 2003

(65) Prior Publication Data

US 2004/0156169 A1 Aug. 12, 2004

(51) Int. Cl.
*H01R 13/627* (2006.01)

(52) U.S. Cl. ..... 439/352

(58) Field of Classification Search ..... 439/357, 439/140–141, 272, 271, 344, 350, 905, 352, 439/358, 274, 581, 582, 312, 314, 318
See application file for complete search history.

(56) References Cited

U.S. PATENT DOCUMENTS

| | | | | |
|---|---|---|---|---|
| 3,742,426 | A * | 6/1973 | Huber et al. | 439/141 |
| 4,647,128 | A * | 3/1987 | Maros | 439/350 |
| 6,398,579 | B1 * | 6/2002 | Banas et al. | 439/350 |
| 6,435,911 | B1 * | 8/2002 | Payson et al. | 439/344 |

FOREIGN PATENT DOCUMENTS

| | | | | |
|---|---|---|---|---|
| JP | 6-231828 | * | 8/1994 | 439/271 |

* cited by examiner

*Primary Examiner*—Alexander Gilman
(74) *Attorney, Agent, or Firm*—Nath & Associates, PLLC; Gregory B. Kang; Matthew J. Moffa

(57) ABSTRACT

The protection device (6) for a plug-in connection comprises a coupling part (1) and a housing (2) for a plug (3) arranged therein: The coupling part (1) has an opening (1*b*) for the plug (3). The opening (1*b*) is surrounded by a protruding collar, which surrounds the opening particularly by 360°. The collar (1*a*) has a hollow recess (1*d*) forming a peripheral groove (1*e*) on the collar (1*a*). The plug housing (2) is provided with a snap-in part (2*f*) which is adapted in relation to the groove (1*e*) in order to connect the housing (2) to the coupling part (19) with the aid of the snap-in part (2*f*) which is engaged in the groove (1*e*).

6 Claims, 3 Drawing Sheets

PROTECTION DEVICE FOR A PLUG-IN CONNECTION

Figure 1:
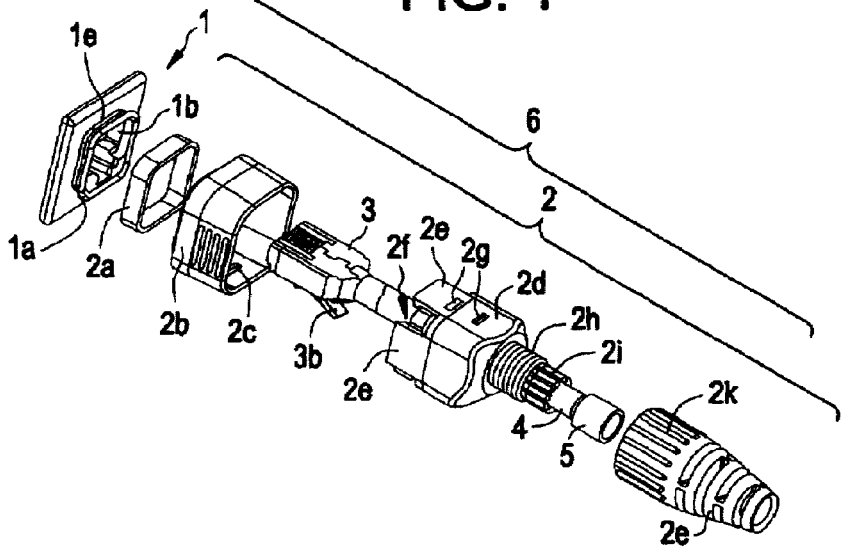

The invention relates to a protection device for a plug-in connection.

A plurality of modular plug-in connection systems are known in order to connect, e.g., telephone lines, computer systems or networks. For example, the RJ45 plug-in connection is a standard according to IEC 60603-7 used worldwide for plug-in connectors in communications and data networks. Such a plug-in connection includes a plug and also a socket. The socket is typically arranged in an outlet, a rack, or a so-called patch panel.

Today, modern fitted buildings have so-called universal building wiring (UGV) with a plurality of sockets in order to connect analog or digital telephones, fax machines, computers, printers, and modems according to need. Here, Ethernet TCP/IP is of special importance, which is gaining more and more acceptance as a manufacturer-independent and economical standard in office spaces and in automation technology.

Disadvantages of these known plug-in connections include the fact that they are rarely suitable for industrial applications, because a reliable network function is not guaranteed under harsh environmental conditions, like those found in industry. Thus, known plug-in connections based on the RJ45 plug-in connector system cannot satisfy a protective class, like IP 67 (according to the IEC 60529 standard), which means that the very common and economical RJ45 plug-in connection cannot be used in the industrial environment, because there are external effects, such as vibrations or negative effects due to coolants or solvents, oils, and the like, and/or dirt and/or dust can impair their use.

Therefore, the problem of the present invention is to form a protection device for a plug-in connection, which enables the use of known plug-in connections in a broader field of use.

The problem is solved in particular with a protection device including a coupling part and also a plug housing for a plug arranged on this coupling part, wherein the coupling part has an opening for the plug, and wherein the opening is surrounded by a protruding collar, which surrounds the opening particularly by 360°, wherein the collar has a surrounding groove, and wherein the plug housing includes a snap-in part adapted to the groove in order to connect the plug housing to the coupling part with the aid of the snap-in part engaged in the groove.

In a preferred embodiment, the plug is formed as an RJ45 plug, wherein the plug, e.g., can also be configured as an optical fiber plug or as a universal serial bus plug, which is also called a USB plug.

The protection device enables a water-tight and/or dust-tight connection of the plug housing with the coupling part.

The coupling part can be configured as a component of the socket. However, in an especially preferred embodiment, the coupling part can be formed with the shape of a flange. This flange-like coupling part is preferably mounted water-tight and/or dirt- and dust-tight in front of the socket. The protection device according to the invention thus enables the plug, especially the RJ45 plug, to be connected to the socket reliably while meeting the requirements of protective class IP 67. For example, the flange-like coupling part is made from metal or a plastic. This flange-like coupling part also has the advantage that existing sockets can be upgraded to the protective class IP 67. The flange-like coupling part can be configured with a flange part with relatively small dimensions, so that the opposing sockets can be arranged at a very small spacing. This flange-like coupling part is thus also suitable for retrofitting of racks, for example. The coupling part has a guide opening for the plug, which guarantees a reliable plug-in connection.

In a preferred embodiment, the plug housing has a seal arranged on its end, which contacts a sealing edge arranged on the collar of the coupling part when the plug-in connection is inserted in order to seal the gap between the plug housing and the coupling part. The plug housing is preferably configured as a robust plastic housing.

The protection device according to the invention thus enables an RJ45 plug-in connection, which meets the requirements of protective class IP 67 and thus is protected against water, dirt, oil, and mechanical damage.

The flange-like coupling part can be integrated at low expense in any device and in any outlet. It can also be installed for any RJ45 socket.

In addition to the sealing function, the protection device according to the invention has both a guidance function to guide the plug reliably and a mechanical connection function to impart increased mechanical resistance to the plug-in connection. Possible vibrations on the plug housing are diverted by the clamping effect of the seal to the coupling part and thus transferred not at all or only in a damped form to the sensitive electrical contacts of the plug. In addition, strain relief of the plug is realized, because tensile forces appearing on the cable act on the coupling part over the plug housing.

Figure 2A:
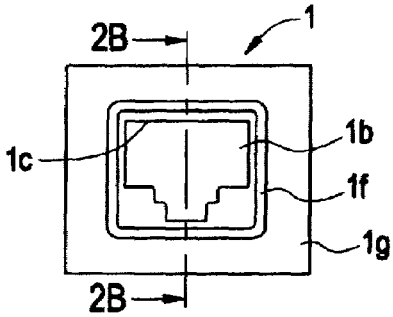
Figure 2B:
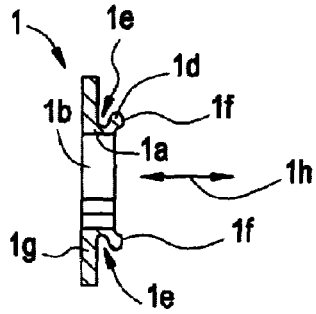
Figure 2C:
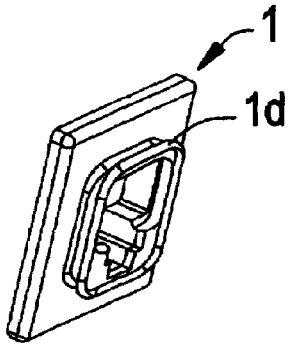
Figure 3:
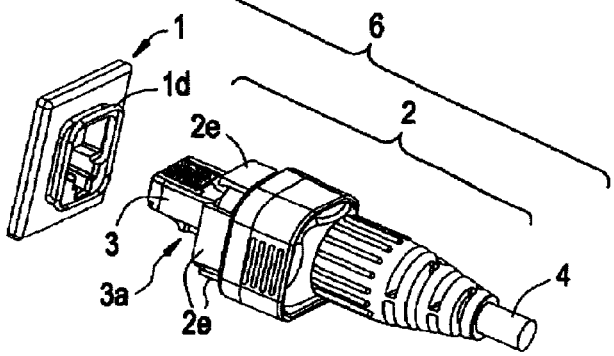

In the following, several embodiments of the invention are described in detail with the aid of figures. Shown are:

FIG. 1, an exploded diagram of a first embodiment of a protection device according to the invention;

FIG. 2*a*, a front view of the coupling part;

FIG. 2*b*, a section through the coupling part along the line 2A—2A from FIG. 2*a*;

FIG. 2*c*, a perspective view of the coupling part;

FIG. 3, a plug housing shortly before the introduction into the coupling part shown in FIG. 2*c;*

Figure 4:
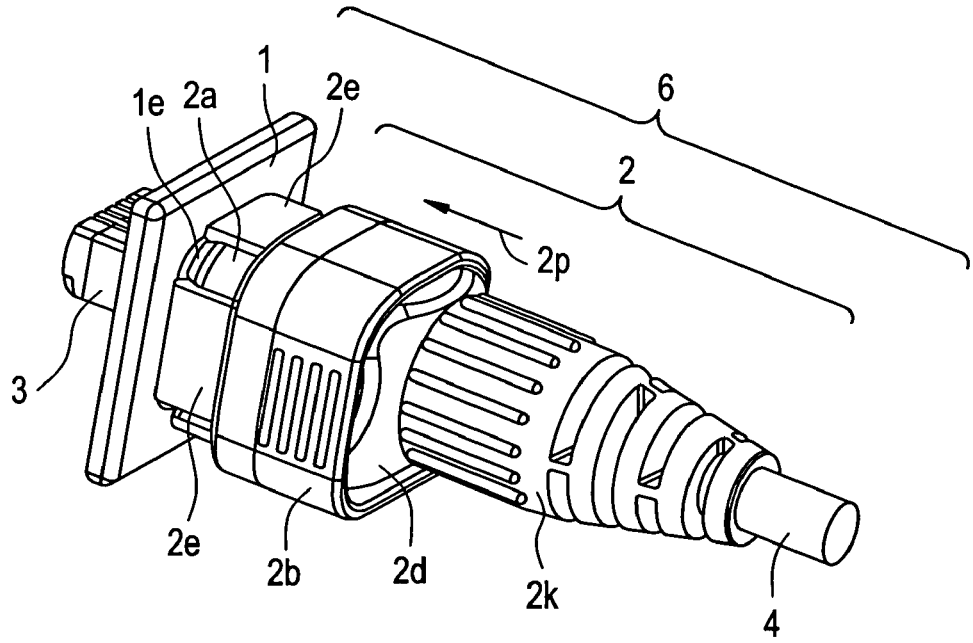
Figure 5:
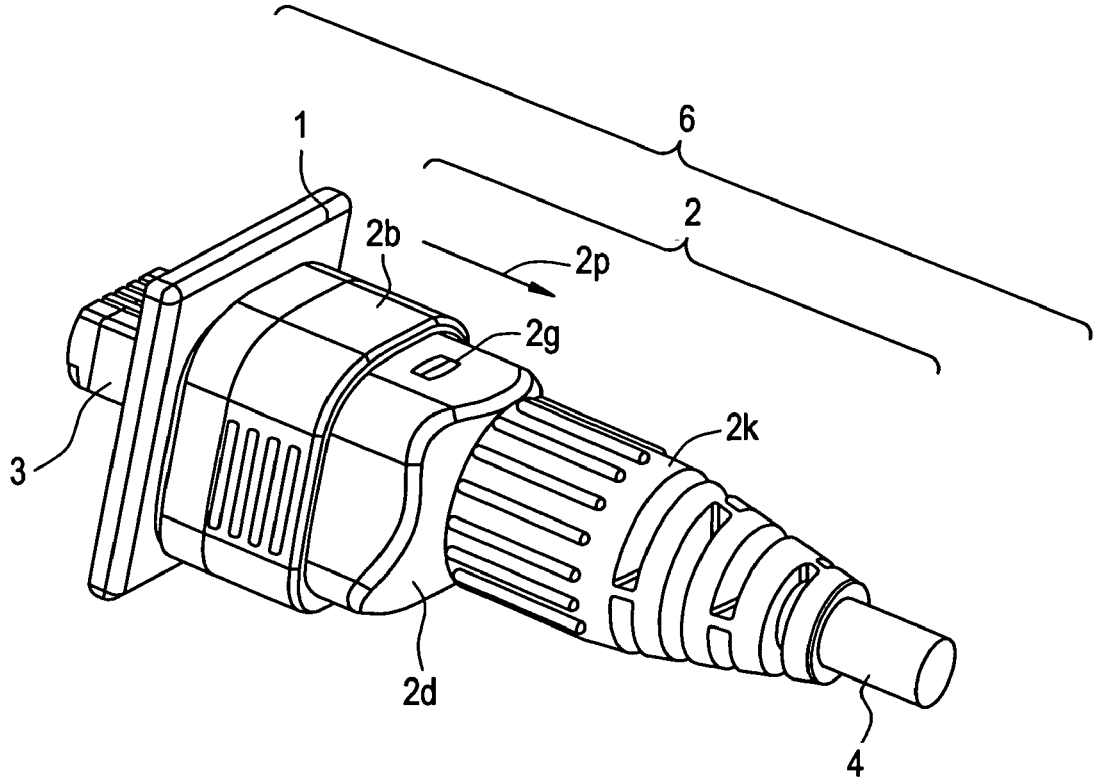
Figure 6:
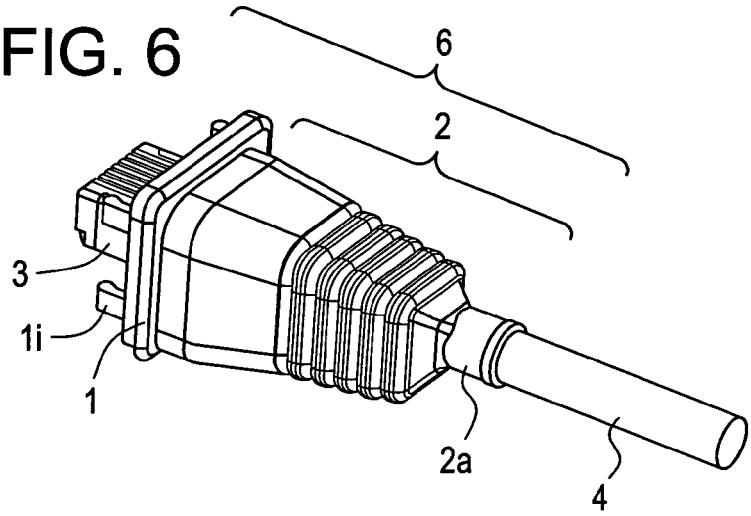
Figure 7:
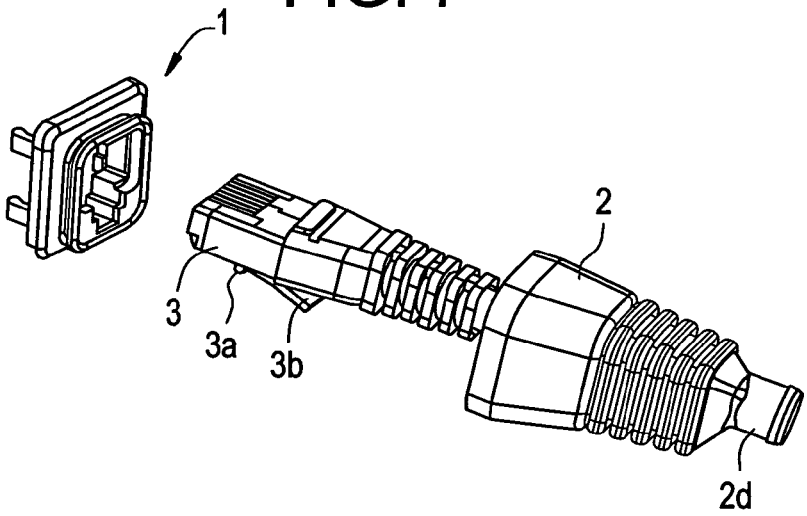
Figure 8:
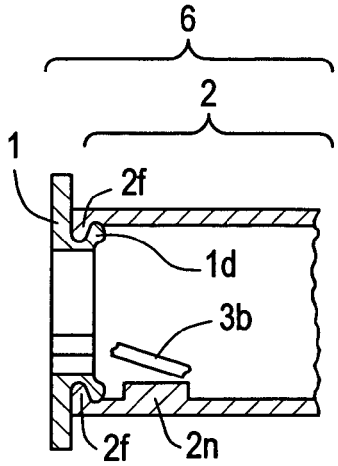

FIG. 4, a plug housing inserted into the coupling part;

FIG. 5, a plug housing locked with the coupling part;

FIG. 6, a second embodiment of a protection device according to the invention;

FIG. 7, an exploded diagram of the protection device according to FIG. 6;

FIG. 8, a longitudinal section through the coupling part and also the plug housing of the second embodiment.

In the figures and the following description, the same constituents are specified with the same reference numbers.

FIG. 1 shows a flange-like coupling part 1, which is arranged in front of a not-shown socket. Details of the coupling part 1 can be seen from the front view shown in FIG. 2*a* and from the section along line 2A—2A shown in FIG. 2*b*. The coupling part 1 includes a flange 1*g* and a collar 1*a* and has a guide opening 1*b* with a guide 1*c* for lateral guidance of the plug 3. It is understood that this flange can also be mounted directly on a front cover and/or a housing, especially under the use of conventional mounting means, such as snap-on connections or screws, and under the use of additional sealing means, such as sealing rings. In one obvious embodiment, this flange is integrated in the housing or more precisely, in the front cover. In the following, all of these embodiments of the flange are designated as flange-like. The collar 1*a* has a projecting bulge 1*d*, which forms a circular, 360° groove 1*e* on the outside of the collar 1*a* at the end shown in FIG. 2*b*. In the shown embodiment, the bulge 1*d* also projects forward over the collar 1*a* so that it forms a sealing edge 1*f*, which encloses the guidance opening 1*b* in the shape of a rectangle, as can be seen from FIG. 2*a*. The plug housing 2 with plug 3 is fed to the coupling part 1 in the direction of movement 1*h*. The collar 1*a* has in direction 1*h* a height extending beyond the flange 1*g* of between, e.g., 1 mm and 5 mm. Preferably, this height equals between 2 mm and 3 mm. The height of the collar 1*a* is dimensioned according to the invention so that the unlocking tab of the plug 3 projects over this collar 1*a* in the inserted state, i.e., in each case it is accessible from the outside and can be activated manually.

The detailed design of the plug housing 2 is shown in FIG. 1. A main housing 2*d* has an interior space such that the plug 3 (in the shown embodiment, an RJ45 plug) is held tightly in this space. The main housing 2*d* includes, e.g., four spring-loaded, tongue-like connecting means 2*e*, which each have an end featuring a snap-in part 2*f* projecting towards the inside. The example four connecting means 2*e* with snap-in parts 2*f* are adapted and arranged such that each snap-in part 2*f* can engage in the groove 1*e* of the coupling part 1. An elastic, annular seal 2*a* is arranged between the connecting means 2*e* and has the task of sealing the gap between the main housing 2*d* and the sealing edge 1*f*. Surface-mounted on the main housing 2*d* is a locking means 2*b* supported so that it can move in the direction of motion 2*p*, which limits the freedom of motion of the spring-loaded connecting means 2*e* according to position. The locking means 2*e* has in the interior at the top and bottom a snap-in projection 2*c*, which is designed to snap into the snap-in recess 2*g*, so that the locking means 2*b* can assume two fixed basic positions with reference to the main housing 2*d*.

The main housing 2*d* also includes threads 2*h*. Ribs 2*i* surrounding the cable 4 are arranged after the threads. There is also a sealing ring 5 surrounding the cable 4. A nut 2*k* with kink protection 21 can be screwed onto the threads 2*h* in order to connect the main housing 2*d* and the cable 4 rigidly to each other and to seal them against each other.

FIG. 3 shows the assembled plug housing 2 shortly before it is inserted together with the plug 3 into the coupling part 1 and the socket arranged behind the coupling part. The locking means 2*b* is pulled back and is located in the first basic position, so that the connecting means 2*e* can execute a spring motion.

In FIG. 4, the plug housing 2 is connected to the coupling part 1 by snapping the example four snap-in parts 2*f* of the plug housing 2 into the groove 1*e*. The seal 2*a* also closes the gap between the sealing edge if and the main housing 2*d*. In this position, the plug housing 2 can be detached from the coupling part 1 again by exerting such a large tensile force on the plug housing 2*d* or the cable 4 that the snap-in parts 2*f* slide out of the groove 1*e* by pushing the spring connecting means 2*e* outwards. An undesired spreading of the connecting means 2*e* is prevented by pushing the locking means 2*b* in the direction 2*p* towards the coupling part 1 into the second basic position, so that the locking means 2*b* assumes the position shown in FIG. 5. In this position, the protection device 6 is locked. The spring connecting means 2*e* cannot spread outwards, so that large tensile forces can be transferred from the plug housing 2 via the snap-in parts 2*f* to the coupling part 1. An advantage of this arrangement is that the protection device 6 receives all or a significant part of these tensile forces, so that these tensile forces do not act on the plug 3 or its electrical connection.

If a protection device 6 is used for an RJ45 plug, as shown in FIGS. 1–5, then the main housing 2*d* is preferably shaped such that the unlocking tab 3*b* of the plug 3 held in the main housing 2*d* constantly contacts the surface of the plug 3. Therefore, the unlocking tab 3*b* cannot be in active connection with the arrangement provided in the socket for locking. The locking between plug 3 and socket is thus not effected by the unlocking tab 3*b*, instead by the locking of the plug housing 2 with the coupling part 1.

As shown in FIG. 5, the locking can be detached by pushing the locking means 2*b* in the direction 2P'.

A second embodiment of the protection device 6 according to the invention is shown in FIGS. 6, 7, and 8. The plug housing 2 is formed as an elastic hollow body, which opens by means of a flexible expansion bellows into a seal 2*a* in order to seal the interior space of the plug housing 2 from the cable 4. The plug housing 2 preferably consists of an elastic, soft plastic. As can be seen from the longitudinal section through the protection device 6 shown in FIG. 8, the plug housing 2 has on the end facing the coupling part 1 a snap-in part 2*f* projecting towards the inside, which preferably extends 360° around the plug housing, so that the snap-in part 2*f* lies in the groove 1*e* over the entire extent of the collar 1*a*. This produces a tight connection between the coupling part 1 and the plug housing 2. Due to the elastic properties of the plug housing 2 formed as a rubber socket, the snap-in part 2*f* can be brought very simply into engagement with the groove 1*e* or can be removed again from the groove 1*e*. The coupling part 1 shown in FIGS. 6 and 7 has a hook 1*i*, e.g., which can engage in correspondingly shaped through holes of a socket cover, so that the coupling part 1 can be set very simply on an existing socket.

The locking of the RJ45 plug 3 is performed in the socket in a known way by means of the locking tab 3*a*, which is a component integrated with the unlocking tab 3*b*, because the elastic plug housing 2 can receive almost no tensile forces. The illustrated protection device is used such that, in a first step, as shown in FIG. 7, the plug 3 is inserted into the coupling part 1 and the plug 3 is locked by the locking tab 3*a* in the socket. Then, as shown in FIG. 6, the elastic plug housing 2 is pushed towards the coupling part 1 and the snap-in part 2*f* is brought into engagement with the groove 1*e*, as shown in FIG. 8. Thus, the plug 3 is protected against contamination and fluids by the protection device 6 surrounding the plug housing 2 and also the coupling part 1.

FIG. 8 shows schematically the position of the unlocking tab 3*b* for the plug 3 inserted into the socket. It can be shown to be advantageous to provide the plug housing 2 with a projection 2*n*, which is arranged such that it comes to lie underneath the unlocking tab 3*b*. To detach the plug 3 from the socket, the plug housing 2 is pressed upwards at the position provided with the projection 2*n*, so that the unlocking tab 3*b* is lifted and the plug connection is unlocked. Then the plug 3 can be pushed together with the plug housing 2. Also for this embodiment, the collar of the coupling part 1 is dimensioned such that the unlocking tab 3*b* is accessible from outside and can be activated manually.

It is understood that the protection device can be combined with known plugs, especially with an optical fiber plug, universal serial bus plug (USB), or RJ45 plug.

The invention claimed is:

1. A protection device (6) for a plug connection, including a coupling part (1) and also a plug housing (2) for a plug to be arranged in this housing, wherein the coupling part (1) has an opening (1*b*) for the plug (3), and wherein the opening (1*b*) is surrounded by a projecting collar (1*a*), wherein the collar (1*a*) has a groove (1*e*), and wherein the plug housing (2) includes at least one snap-in part (2*f*) adapted to the groove (1*e*) in order to connect the plug housing (2) to the coupling part (1) with the aid of the snap-in part (2*f*) engaged in the groove (1*e*), characterized in that the plug housing (2) includes a main housing (2*d*) for receiving the plug (3), and in that the one or more snap-in parts (2*f*) are connected to the main housing (2*d*) by spring connecting means (2*e*), and further characterized in that the plug housing (2) includes four tongue-like connecting means (2*e*), which are arranged with a rectangular shape, and in that the snap-in parts (2*f*) are arranged on the tips of the connecting means (2*e*) such that all snap-in parts (2*f*) can engage in the groove (1*e*).

2. A protection device (6) for a plug connection, including a coupling part (1) and also a plug housing (2) for a plug to be arranged in this housing, wherein the coupling part (1) has an opening (1*b*) for the plug (3), and wherein the opening (1*b*) is surrounded by a projecting collar (1*a*), wherein the collar (1*a*) has a groove (1*e*), and wherein the plug housing (2) includes at least one snap-in part (2*f*) adapted to the groove (1*e*) in order to connect the plug housing (2) to the coupling part (1) with the aid of the snap-in part (2*f*) engaged in the groove (1*e*), characterized in that the plug housing (2) includes locking means (2*b*), which can move into a released position and a locked position, and which is shaped to act on the snap-in parts (2*f*) such that the locking means (2*b*) permits or prevents motion of the snap-in parts (2*f*) depending on its position.

3. The protection device (6) according to claim 2, characterized in that the locking means (2*b*) is shaped as a rectangular ring body, which is supported on the main housing (2*d*) so that it can move in the extension direction of the plug housing (2).

4. A protection device (6) for a plug connection, including a coupling part (1) and also a plug housing (2) for a plug to be arranged in this housing, wherein the coupling part (1) has an opening (1*b*) for the plug (3), and wherein the opening (1*b*) is surrounded by a projecting collar (1*a*), wherein the collar (1*a*) has a groove (1*e*), and wherein the plug housing (2) includes at least one snap-in part (2*f*) adapted to the groove (1*e*) in order to connect the plug housing (2) to the coupling part (1) with the aid of the snap-in part (2*f*) engaged in the groove (1*e*), characterized in that the plug housing (2) has a seal (2*a*), which is adapted for contact on the collar (1*a*), on an end facing the coupling part (1).

5. A protection device (6) for a plug connection, including a coupling part (1) and also a plug housing (2) for a plug to be arranged in this housing, wherein the coupling part (1) has an opening (1*b*) for the plug (3), and wherein the opening (1*b*) is surrounded by a Projecting collar (1*a*), wherein the collar (1*a*) has a groove (1*e*), and wherein the plug housing (2) includes at least one snap-in part (2*f*) adapted to the groove (1*e*) in order to connect the plug housing (2) to the coupling part (1) with the aid of the snap-in part (2*f*) engaged in the groove (1*e*), characterized in that the collar (1*a*) has a bulge (1*d*), which projects forward of an end surface and which forms a sealing edge (1*f*).

6. A protection device (6) for a plug connection, including a coupling part (1) and also a plug housing (2) for a plug to be arranged in this housing, wherein the coupling part (1) has an opening (1*b*) for the plug (3), and wherein the opening (1*b*) is surrounded by a projecting collar (1*a*), wherein the collar (1*a*) has a groove (1*e*), and wherein the plug housing (2) includes at least one snap-in part (2*f*) adapted to the groove (1*e*) in order to connect the plug housing (2) to the coupling part (1) with the aid of the snap-in part (2*f*) engaged in the groove (1*e*), characterized in that the plug housing (2) is formed as an elastic, hollow body, which has a snap-in part (2*f*), which extends 360° around the plug housing, on its flange-side end, and further characterized in that the plug housing (2) has a projection (2n) projecting towards its inside, which is arranged relative to the plug (3) such that an unlocking tab (3*b*) comes to lie over the projection (2*n*).

* * * * *